United States Patent [19]

Loew

[11] 4,352,478

[45] Oct. 5, 1982

[54] ARTICLE HOLDING ASSEMBLY

[75] Inventor: Jonathan A. Loew, New York, N.Y.

[73] Assignee: P.O.P. Displays, Inc., Long Island City, N.Y.

[21] Appl. No.: 199,294

[22] Filed: Oct. 20, 1980

[51] Int. Cl.[3] ..... A44B 13/00

[52] U.S. Cl. ..... 248/221.3

[58] Field of Search ..... 248/73, 214, 215, 221.3, 248/221.4, 226.5

[56] References Cited

U.S. PATENT DOCUMENTS

| | | | |
|---|---|---|---|
| 725,678 | 4/1903 | Cullum | 248/221.3 X |
| 2,291,966 | 8/1942 | Joseph | 248/215 |
| 2,665,869 | 1/1954 | Samuels | 248/226.5 X |
| 2,954,954 | 10/1960 | Larson | 248/215 |
| 3,193,229 | 7/1965 | Stock | 248/226.5 X |
| 3,300,168 | 1/1967 | Gaudino | 248/226.5 X |
| 3,965,540 | 6/1976 | Moore | 248/215 X |
| 4,085,867 | 4/1978 | Heller | 248/215 X |
| 4,300,692 | 11/1981 | Moreno | 248/221.3 X |

FOREIGN PATENT DOCUMENTS

| | | | |
|---|---|---|---|
| 56863 | 12/1942 | Netherlands | 248/73 |

*Primary Examiner*—William H. Schultz

*Attorney, Agent, or Firm*—Steinberg & Raskin

[57] ABSTRACT

An article holding assembly includes at least one article holding member, such as a hook member, having an elongate shank portion and a base to one surface of which it is affixed, a pair of vertically spaced fastening elements affixed to the other base surface, and an elongate retainer member including a pair of vertically spaced, parallelly extending fastening rails, the fastening elements and fastening rails being constructed such that the article holding member can be snap fastened to the retainer member at any location along its length in a manner such that it can be adjustably positioned as desired at any location along the length of the retainer member. The retainer member can comprise an extruded member or an injected molded member and can be formed as part of a shelf, cabinet or the like.

12 Claims, 7 Drawing Figures

FIG. 4
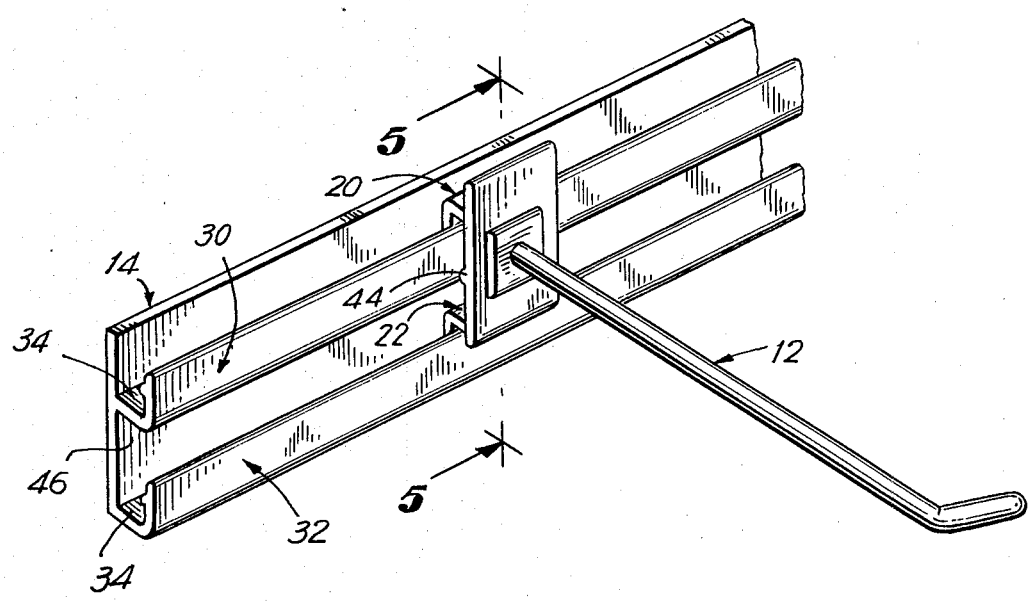
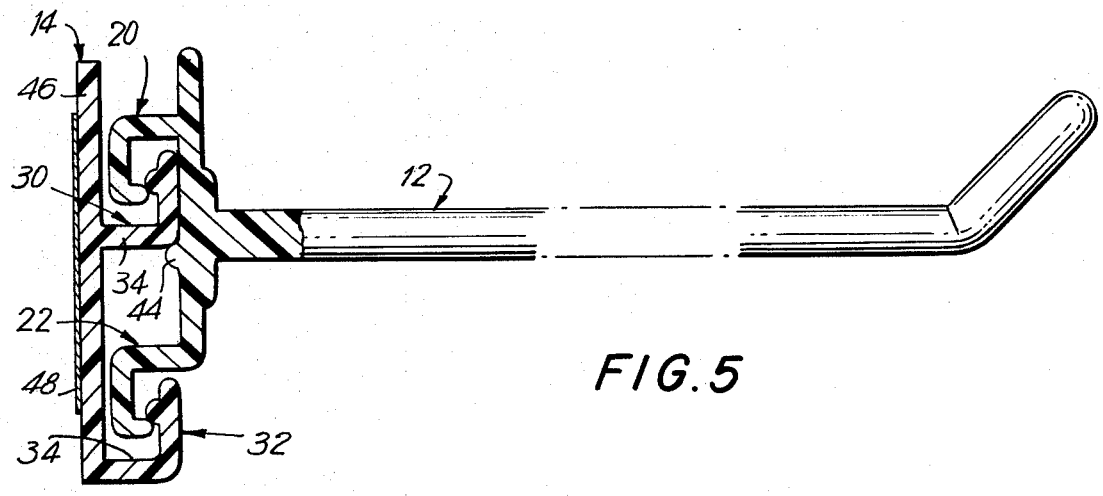
FIG. 5

FIG. 6
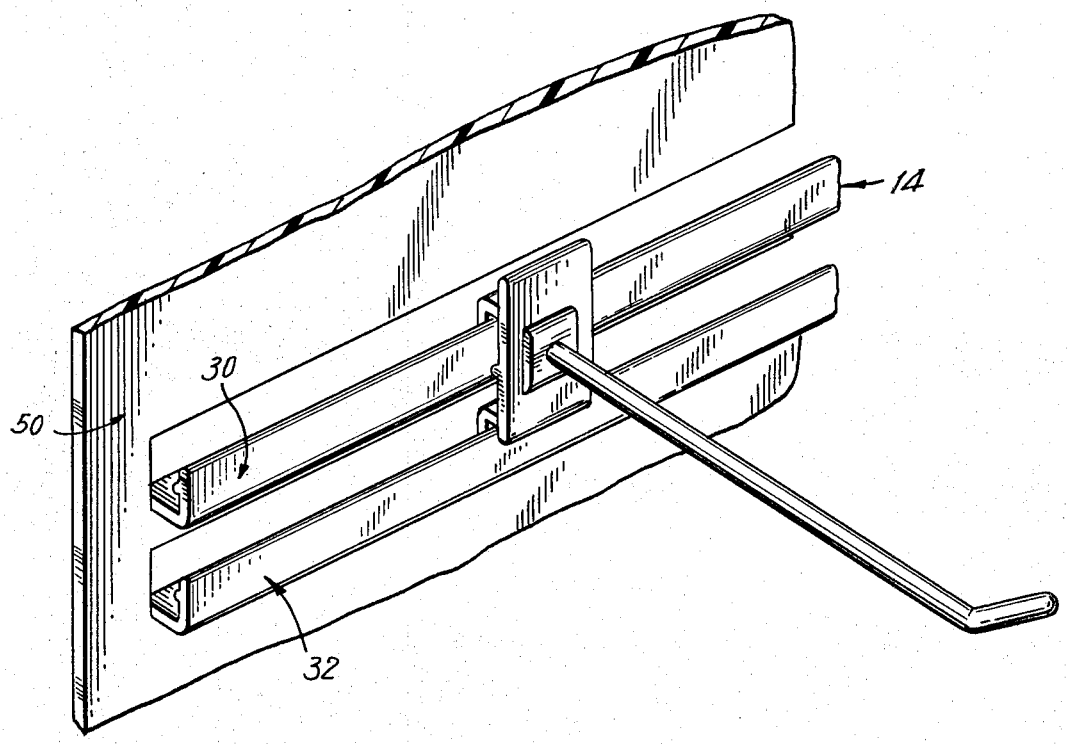
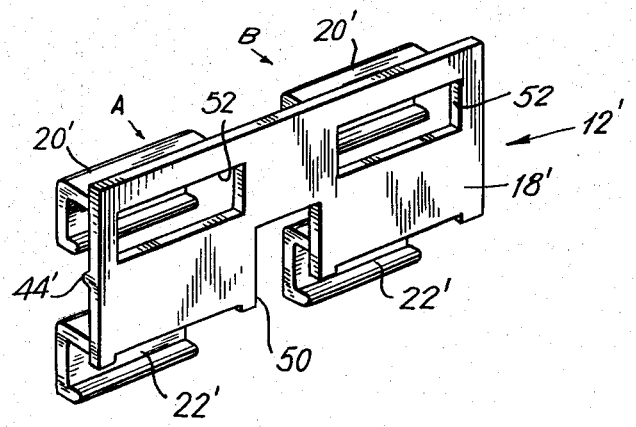
FIG. 7

ARTICLE HOLDING ASSEMBLY

BACKGROUND OF THE INVENTION

This invention relates, generally, to assemblies for holding articles such, for example, as "point of purchase" merchandise, articles of clothing, shelves, etc., and, more particularly, to article holding assemblies of the type comprising at least one article holding member, such as a hook member, and an elongate retainer member to which the article holding member is adapted to be attached at any desired location along its length so as to be adjustably positionable thereon.

Article holding assemblies comprising one or more article holding members, such as hook members, which are adapted to be attached to elongate retainer members are generally known. In this connection, reference is made to U.S. Pat. Nos. 1,800,387; 2,291,966; 2,754,974; and 2,942,831.

Thus, assemblies are known wherein article supporting members are adapted to be associated with elongate retainer members, the latter being affixable to wall members or the like, and wherein a plurality of such article holding members associated with the retainer member can be moved longitudinally along the length thereof for various reasons as desired.

Known article holding assemblies including some of those described above are not, however, entirely satisfactory for all applications. More particularly, some conventional assemblies are deficient in that it is not possible to associate the article holding members with the elongate retainer member in a positively secured or locked manner. This is due to the fact that such assemblies are designed so that the article holding members when associated with the elongate retainer member are longitudinally movable with respect thereto so that the manner in which the respective assemblies are mutually attached must provide for certain tolerances or "play" at the points of attachment. Such provision results in the article holding members when attached to the retainer member tending to wobble during use which, of course, is undesirable. Thus, in some of the prior art assemblies, the application of a load to the article holding member causes the latter to deflect under the load which, at best, is undesirable and, at worst, is unacceptable.

Some of the prior art assemblies described above also are limited in use in that the article holding members can be associated with the elongate retainer member only at certain discrete points along the length thereof. Thus, it is necessary in certain situations that the article holding member be attached to the retainer member at a certain position and only then can the holding member be moved longitudinally. This is disadvantageous under circumstances where other holding members have already been associated with the retainer member and where the addition of a new holding member necessitates an adjustment in the positions of the holding members already associated with the retainer member.

SUMMARY OF THE INVENTION

Accordingly, one object of the present invention is to provide new and improved article holding assemblies of the type wherein at least one article holding member is adapted to be attached to an elongate retainer member so that the former can be subsequently moved to any desired position on the latter.

Another object of the present invention is to provide new and improved article holding assemblies of the type described above wherein a positive locking or securement of the article holding member to the retainer member is provided and yet which permits the article holding member to be located at any desired longitudinal position with respect to the retainer member.

Still another object of the present invention is to provide new and improved article holding assemblies of the type described above and wherein the article holding member can be initially associated with the retainer member at any desired location thereon and so that the position of article holding members previously associated with the retainer member need not be adjusted to accommodate the newly added holding member.

Yet another object of the present invention is to provide new and improved article holding assemblies of the type described above wherein the retainer member comprises a member which can be either entirely extruded or entirely formed by injection molding techniques.

Briefly, in accordance with the present invention, these and other objects are attained by providing an article holding assembly comprising at least one article holding member including an elongate shank portion, a base to one surface of which the end of the shank portion is affixed and a pair of vertically spaced fastening elements affixed to the other base surface, and an elongate retainer member to which the article holding member is adapted to be attached which includes a pair of vertically spaced, parallelly extending fastening rails, the structure of the fastening elements and rails being such that the article holding member can be fastened to the retainer member at any location along the length thereof in a manner such that the same is positively locked thereto and yet which allows the holding member to be adjustably longitudinally positioned as desired.

More particularly, the fastening elements provided on the article holding member are located one above the other so as to define upper and lower fastening elements. Each fastening element includes an outwardly extending fastener web affixed to the base side surface, a fastener flange extending substantially downwardly from the web and an inwardly directed fastener bead formed on the flange. The fastening rails of the retainer member are themselves located one above the other so as to define upper and lower fastening rails. Each fastening rail includes an outwardly extending elongate retaining web, an elongate retaining flange which extends substantially upwardly from the web and an inwardly directed retaining bead formed on the retaining flange.

The vertical distances between the fastener beads and the retaining beads, respectively, are substantially equal to each other and a locking bead is preferably formed on the surface of the base and extends horizontally between the fastening elements parallel to and somewhat below the fastening bead of the upper fastening element. The total thickness of the retaining flange and the associated retaining bead of at least the upper fastening rail is preferably greater than the horizontal distance between the locking bead and the innermost extremity of the fastening bead of the upper fastening element.

The article holding member is "snapped" into locking engagement with the retainer member in a manner described in detail below with the locking bead eventually engaging the retaining web of the upper one of the fastening rails to provide a positive locking engagement of the article holding member to the retainer member while allowing the former to be longitudinally positioned at any desired location on the latter.

The particular construction of the retainer member described above renders the same amenable to construction in its entirety as an extruded member or, alternatively, as an injected molded member. Thus, the retainer member can be integrally formed as an edge surface of a shelf or as part of a cabinet or the like.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 4 is a perspective view of an article holding assembly according to the present invention and illustrating a retainer member which comprises an extruded member;

FIG. 5 is a section view taken along line 5—5 of FIG. 4;

FIG. 6 is a perspective view of an article holding assembly according to the present invention and illustrating the retainer member as comprising an injected molded member; and FIG. 7 is a perspective view of another embodiment of an article holding member for use with the article holding assembly of the present invention.

DESCRIPTION OF THE PREFERRED EMBODIMENTS

Figure 1:
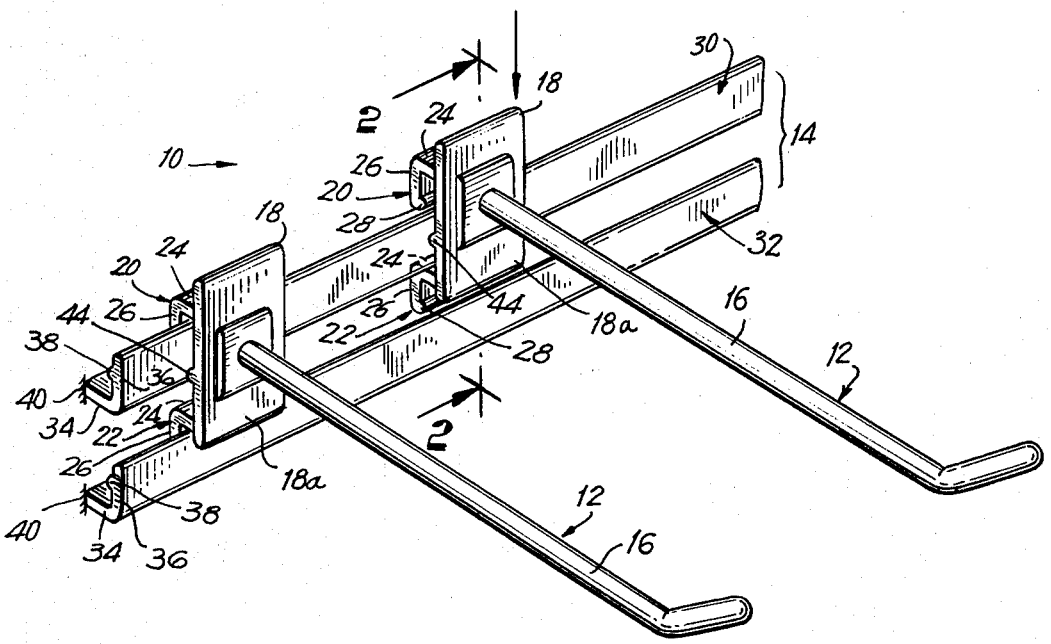
FIG. 1 is a perspective view of the article holding assembly of the present invention showing the retainer member in a schematic fashion and also showing one article holding member attached to the retainer member and another article holding member in position for attachment thereto.
Figure 2:
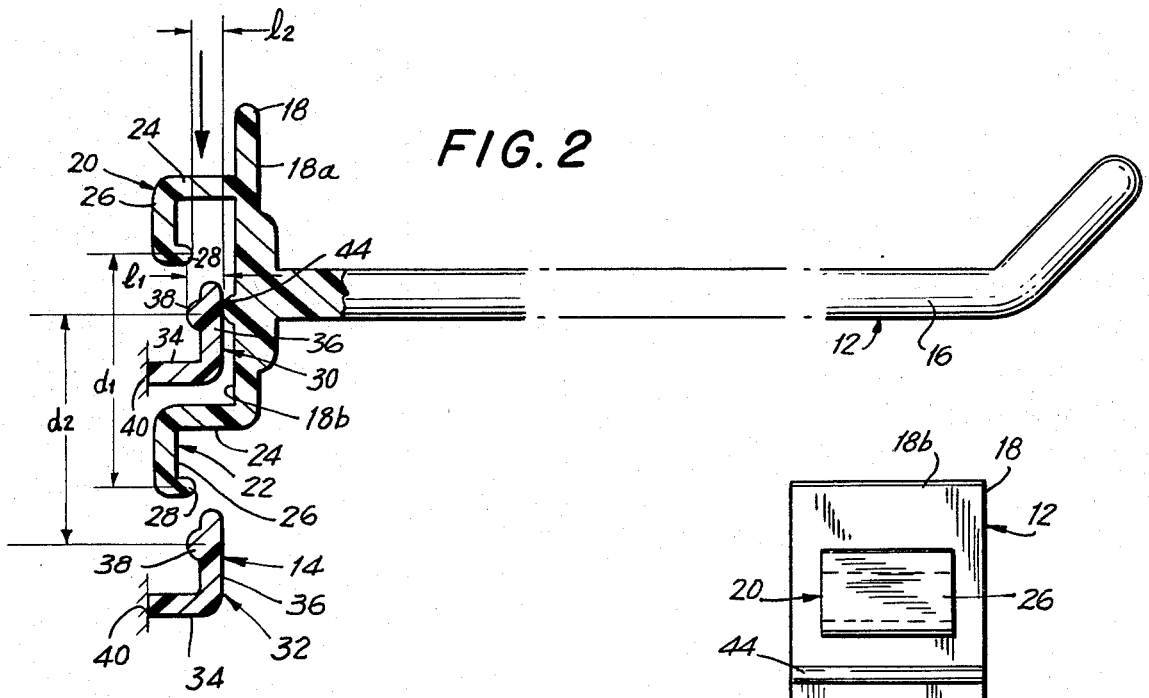
FIG. 2 is a section view taken along line 2—2 of FIG. 1.
Figure 3:
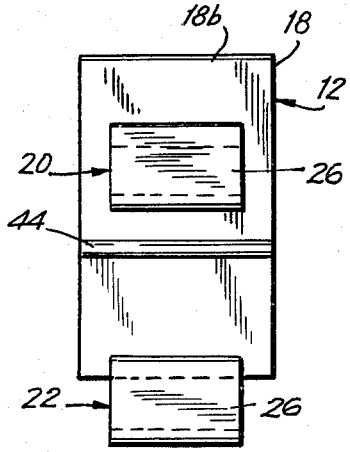
FIG. 3 is a rear view of an article holding member for use in connection with the assembly of the present invention.

Referring now to the drawings wherein like reference characters designate identical or corresponding parts throughout the several views, and more particularly to FIGS. 1–3, an article holding assembly, generally designated 10, constructed according to the present invention is illustrated. The article holding assembly 10 generally comprises one or more article holding members 12 and an elongate retainer member 14 to which the article holding member is adapted to be attached.

The article holding member 12 which in the illustrated embodiment comprises a hook member includes an elongate shank portion 16 which is attached at one of its ends to a side surface **18*a* of a base 18. A pair of vertically spaced fastening elements 20, 22 are affixed to the other side surface 18*b* of base 18, one above the other so that fastening element 20 comprises an upper fastening element while fastening element 22** comprises a lower fastening element.

Each fastening element includes a fastener web 24 which is affixed to base side surface **18*b* and extends outwardly therefrom, a fastener flange 26 which extends in a substantially downward direction from the fastener web 24, and an inwardly directed fastener bead 28 formed on the fastener flange 26**.

The retainer member 14 comprises an elongate member and includes a pair of vertically spaced, parallelly extending fastening rails located one above the other so as to define an upper fastening rail 30 and a lower fastening rail 32. Each fastening rail includes an outwardly extending elongate retaining web 34, an elongate regaining flange 36 which extends in a substantially upward direction from the web 34, and an inwardly directed retaining bead 38 formed on the retaining flange 36. The upper and lower fastening rails 30, 32 are fixed in space with respect to each other as schematically illustrated at 40 in FIG. 1. Thus, it is understood that the fastening rails can extend from an integral wall member or from any other structure which will maintain the fastening walls in fixed relation with respect to each other as illustrated in FIGS. 1 and 2.

At least one of the article holding and retainer members 12, 14 are preferably formed of plastic material which is relatively rigid but which will deform at least slightly under pressure. For example, medium or high impact styrene plastic material has been found especially suitable for use in this connection.

According to the invention, the vertical distance, designated $d_1$, between the fastener beads 28 of the upper and lower fastening elements 20, 22 is substantially equal to the vertical distance, designated $d_2$, between the retaining beads 38 of the upper and lower fastening rails 30, 32.

Referring to FIGS. 2 and 3, a locking bead 44 is formed on the side surface **18*b* of base 18 and extends substantially horizontally between the fastening elements 20, 22. The total thickness, designated $l_1$, of the retaining flange 36 and the associated retaining bead 38 of at least the upper fastening rail 30 is at least slightly greater than the horizontal distance, designated $l_2$, between the locking bead 44 and the innermost extremity of the fastening bead 28 of the upper fastening element 20. The locking bead 44 is appropriately positioned on base surface 18*b* so that the same engages the retaining web 34 of the upper fastening rail 30 upon the article holding member 12 being associated with the retainer member 14 as will be more fully described in connection with the embodiment of the invention illustrated in FIG. 5**.

In operation, the article holding member 12 is fastened to the retainer member 14 at any location along the length thereof by locating the holding member such that the upper and lower fastening elements 20, 22 are located vertically over the upper and lower fastening rails 30, 32, respectively, as seen in FIG. 2, with the upper and lower retaining flanges 36 being substantially vertically aligned with the upper and lower receiving passages 42, respectively. The article holding member 12 is then urged downwardly. The fastening beads 28 of the fastening elements 20, 22 then engage the retaining beads 38 of the fastening rails 30, 32, respectively with the camming and locking bead being urged against the outer surface of the retaining flange 36 of the upper fastening rail by virtue of the camming action provided by the engagement of the fastening and retaining beads which tends to urge the holding member toward the retainer member. Due to the fact that the total thickness $l_1$ of the retaining flange and respective retaining bead of the upper fastener rail is slightly greater than the distance $l_2$ between the upper fastening and locking beads, it is necessary to exert an increased downward force on the base 18 of the article holding member 12 until the interfering beads 28, 38, locking bead and/or base member 18, deform whereupon the retaining beads 38 pass upwardly over the fastening beads 28 to "snap" the article holding member 12 into connection with the retainer member 14.

Due to the fact that the distance $d_1$ between the fastener beads 28 is substantially equal to the distance $d_2$ between the retaining beads 38, the upper and lower fastening elements 20, 22 will simultaneously snap into association with the upper and lower fastening rails 30, 32.

Simultaneously, the locking bead 44 engages the undersurface of the retaining web 34 of the upper fastening rail 30 as seen in FIGS. 1 and 5 in order to provide an even more secure, positive locking engagement of the article holding member 12 to the retaining member 14. More particularly, due to this engagement of the locking bead 44 with the retaining web 34, the article holding member 12 is prevented from "wobbling" as well as inadvertently becoming disengaged from the retainer member 14.

It will be appreciated that after the article holding member 12 has been associated with the retainer member 14 in the manner described above, the location of the former on the latter can be adjusted as desired. It is further seen that the article holding member 12 can be "snapped" onto the retainer member 14 at any location as may be desired without the necessity of moving other article holding members which may have been previously associated with the retainer member.

By virtue of the particular construction of the assembly 10, it is possible to form the retainer member 14 as an entirely extruded member or, alternatively, as an injected molded member.

More particularly, referring to FIGS. 4 and 5, the retainer member 14 comprises an extruded member. Thus, the upper and lower fastening rails 30, 32 are formed integrally with an elongate planar wall member 46, i.e., the retaining webs 34 are integrally formed with and extend outwardly from the wall member 46. The engagement of the fastening elements 20, 22 with the fastening rails 30, 32 is illustrated in FIG. 5 and in this connection, the engagement of the locking bead 44 with the retaining web 34 of the upper fastening rail 30 is illustrated and it will be appreciated that such engagement prevents any inadvertent upward movement of the article holding member 12 with respect to the retainer member 14. Means for affixing the retainer member 14 to a wall or the like is provided on the inner surface of planar wall member 46. Thus, a layer of pressure sensitive adhesive material 48 (FIG. 5) may be provided on the inner surface of the wall member 46 so that the retainer member 14 can be affixed to any wall member, shelf, etc. and at any height as desired.

Referring to FIG. 6, the retainer member 14 is illustrated as comprising an injected molded member and, in particular, comprises a panel member 50 from which the fastening rails 30, 32 integrally extend. Pressure sensitive adhesive material or other conventional fastening means can be provided on the other surface of the panel member 50 so that the latter can be affixed to any wall member or the like as desired. Further, the injection molded retainer member can itself comprise an edge surface of a shelf or a cabinet or any other component amenable for manufacture by injection molding.

Turning now to FIG. 7, another embodiment of an article holding member, designated 12', is illustrated and unlike the hook type article holding member described above in connection with FIGS. 1–6, comprises a hanger type holder member. More particularly, the hanger type article holding member 12' is preferably formed by injection molding and includes a planar base 18' from which two pairs A and B of vertically spaced fastening elements 20', 22' are affixed, longitudinally spaced from one another. A locking head 44' is formed between the fastening elements in the same manner as in the previously described embodiments. A regangular contact 50 is formed in the lower region of base 18' intermediate of the pairs of fastening elements A and B while openings 52 are also provided as shown.

Practically any type of article desired to be mounted can be hung from the hanger member 12' via openings 52 and/or cutout 50. Thus, the member 12' is engaged to a retainer member of the same structure described above and the unit desired to be mounted may be affixed thereto.

Obviously, numerous modifications and variations of the present invention are possible in the light of the above teachings. For example, it is possible to eliminate the locking bead from the base of the article holding member in which case the latter should be configures such that the surface **18*b* of the base 18 interferes with the outer surface of the retaining flange 36** during engagement of the holding member to the retaining member. It is therefore to be understood that within the scope of the claims appended hereto, the invention may be practiced otherwise than as specifically disclosed herein.

What is claimed is:

1. An article holding assembly comprising:

at least one article holding member including a base, and a pair of vertically spaced fastening elements affixed to one of said base side surfaces one above the other so as to define upper and lower fastening elements, each fastening element including an outwardly extending fastener web affixed to said base side surface, a fastener flange extending substantially downwardly from said web, and an inwardly directed fastener bead formed on said flange; and an elongate retainer member to which said article holding member is adapted to be attached, said retainer member including a pair of vertically spaced, parallelly expending fastening rails located one above the other so as to define upper and lower fastening rails, each fastening rail including an outwardly extending elongate retainer web, an elongate retaining flange extending substantially upwardly from said web, and an inwardly directed retaining bead formed on said retaining flange; and wherein the vertical distances between said fastener beads on an article holding member and said retaining beads on the retainer member, respectively, are substantially equal to each other;

whereby said article holding member is adapted to be fastened to said retainer member at any location along the length thereof by locating said holding member such that the upper and lower fastening elements are located vertically over the upper and lower fastining rails, respectively, with said upper and lower retaining flanges being substantially vertically aligned with said upper and lower receiving passages, respectively, whereupon said hook member is urged downwardly until said retaining and fastening beads deform until the retaining beads pass through respective receiving passages.

2. The combination of claim 1 wherein said article holding member further includes a locking bead formed on said base side surface extending between said fastening elements and adapted to engage the retaining web of the upper one of said fastening rails to provide a reliable locking engagement of said article holding member to said retainer member.

3. The combination of claim 2 wherein the total thickness of the retaining flange and associated retaining bead of at least the upper fastening rail is at least slightly greater than the horizontal distance between the locking bead and the fastening bead of the upper fastening element.

4. The combination recited in claim 3 wherein said retainer member comprises in its entirety an extruded member.

5. The combination of claim 4 wherein said retainer member further includes an elongate planar wall member, said fastening rails being integrally formed with and extending from one surface of said wall member and further including means for affixing said retainer member to a wall provided on the other surface of said planar wall member.

6. The combination of claim 3 wherein said retainer member comprises an injection molded member.

7. The combination of claim 6 wherein said retainer member comprises a panel member, said fastening rails being integrally formed with and extending from one surface of said panel member and further including means for affixing said retainer member to a wall provided on the other surface of said panel member.

8. The combination of claim 6 wherein said retainer member comprises an edge surface of a shelf.

9. The combination of claim 6 wherein said retainer member comprises a cabinet.

10. The combination of claim 1 wherein said article holding member comprises a hook type member and includes a shank portion having one end fixed to the other side surface of said base.

11. The combination of claim 1 wherein said article holding member includes a hanger member and includes two pairs of vertically spaced fastening elements affixed thereto.

12. The combination of claim 11 wherein at least one opening is formed in said base member for hanging an article therefrom.

* * * * *